US006192334B1

(12) United States Patent
Nomura

(10) Patent No.: US 6,192,334 B1
(45) Date of Patent: Feb. 20, 2001

(54) AUDIO ENCODING APPARATUS AND AUDIO DECODING APPARATUS FOR ENCODING IN MULTIPLE STAGES A MULTI-PULSE SIGNAL

(75) Inventor: Toshiyuki Nomura, Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/053,606

(22) Filed: Apr. 1, 1998

(30) Foreign Application Priority Data

Apr. 4, 1997 (JP) ..... 9-086663

(51) Int. Cl.[7] ..... G10L 19/04

(52) U.S. Cl. ..... 704/219; 704/220; 704/226; 704/222

(58) Field of Search ..... 704/207, 222, 704/219, 231, 226, 220, 200

(56) References Cited

U.S. PATENT DOCUMENTS

| | | | | |
|---|---|---|---|---|
| 4,890,327 | * | 12/1989 | Bertrand et al. | 704/219 |
| 4,980,916 | * | 12/1990 | Zinser | 704/207 |
| 5,060,269 | * | 10/1991 | Zinser | 704/220 |
| 5,091,945 | * | 2/1992 | Kleijn | 704/219 |
| 5,097,507 | * | 3/1992 | Zinser et al. | 704/226 |
| 5,127,053 | * | 6/1992 | Koch | 704/207 |
| 5,138,661 | * | 8/1992 | Zinser et al. | 704/219 |
| 5,193,140 | | 3/1993 | Minde | 704/200 |
| 5,307,441 | * | 4/1994 | Tzeng | 704/222 |
| 5,633,980 | * | 5/1997 | Ozawa | 704/222 |
| 5,826,222 | * | 10/1998 | Griffin | 704/207 |

FOREIGN PATENT DOCUMENTS 4-171500 6/1992 (JP) .

OTHER PUBLICATIONS

"Embedded Algebraic Celp Coders For Wideband Speech Coding", A. Le Guyader et al., Signal Processing Theories and Applications, Brussels, Aug. 24–27, 1992, vol. 1, No. Conf. 6, pp. 527–530.

"Experiments With A Regular Pulse Celp Coder for The Pan European Half Rate Channel", C. Gruet et al., Speech Processing 1, Toronto, May 14–17, 1991, vol. 1, No. Conf. 16, pp. 617–620.

R. Drogo De Iacovo, et al., "Embedded CELP Coding For Variable Bit–Rate Between 6.4 and 9.6 Kbit/s", Proc. of ICASSP, 1991, pp. 681–684.

A. Le Guyader, et al., "Embedded Algebraic CELP Coders for Wideband Speech Coding", Proc. of EUSIPCO, Signal Processing VI, 1992, pp. 527–530.

"Digital Audo Processing", published by Tohkai University Press, Japan, Chapter 5, pp. 60–65.

N. Sugamura, et al., "Speech Data Compression by LSP Speech Analysis–Synthesis Technique", Journal of the IEICE, J64–A, No. 8, 1981, pp. 599–606.

J–P. Adoul, et al., "Fast CELP Coding Based on Algebraic Codes", Proc. of ICASSP, 1987, pp. 1957–1960.

* cited by examiner

*Primary Examiner*—David R. Hudspeth
*Assistant Examiner*—Vijay B Chawan
(74) *Attorney, Agent, or Firm*—Ostrolenk, Faber, Gerb & Soffen, LLP

(57) ABSTRACT

Auxiliary multi-pulse setting circuit 130 set candidates of pulse positions so that the pulse positions to which no pulse is located are selected in auxiliary multi-pulse searching circuit 131 prior to the pulse positions at which pulses have already been encoded in multi-pulse searching circuit 110. Auxiliary multi-pulse searching circuit 131 generates an auxiliary multi-pulse signal according to the candidates of pulse positions set in auxiliary multi-pulse setting circuit 130 and encodes the auxiliary multi-pulse signal so that difference between the reproduced audio signal which is obtained by driving a linear predictive synthesis filter with the auxiliary multi-pulse signal and an input audio signal is minimized similarly to multi-pulse searching circuit 110.

50 Claims, 4 Drawing Sheets

AUDIO ENCODING APPARATUS AND AUDIO DECODING APPARATUS FOR ENCODING IN MULTIPLE STAGES A MULTI-PULSE SIGNAL

BACKGROUND OF THE INVENTION

1. Field of the Invention

The present invention relates to an audio encoding apparatus and audio decoding apparatus which adopt a hierarchical encoding/decoding method.

2. Description of the Prior Art

Heretofore, the aim of introducing an audio encoding apparatus and decoding apparatus which adopt the hierarchical encoding method which enables decoding audio signals from a part of a bitstream of encoded signals as well as all of it, is to cope with the case that a part of the packets of encoded audio signals are lost in a packet transmission network. An example of such apparatus based on the CELP (Code Excited Linear Prediction) encoding method comprises excitation signal encoding blocks in a multistage connection. This is disclosed in "Embedded CELP coding for variable bit-rate between 6.4 and 9.6 kbit/s" by R. Drog in proceedings of ICASSP, pp. 681–684, 1991 and "Embedded algebraic CELP coders for wideband speech coding" by A. Le Guyader, et. al. in proceedings of EUSIPCO, signal processing VI, pp. 527–530, 1992.

With reference to FIGS. 2A and 2B, the operation of an example of the prior art will be explained. Although only two excitation signal encoding blocks are connected in the example for simplicity, the following explanation can be extended to the structure of three or more stages.

Frame dividing circuit 101 divides an input signal into frames and supplies the frames to sub-frame dividing circuit Sub-frame dividing circuit 102 divides the input signal in a frame into sub-frames and supplies the sub-frames to linear-predictive analysis circuit 103 and psychoacoustic weighting signal generating circuit 105.

Linear predictive analyzing circuit 103 applies linear predictive analysis to each sub-frame of the input from sub-frame dividing circuit 102 and supplies linear predictor coefficients a(i) (i=1,2,3, . . . , Np) to linear predictor coefficient quantizing circuit 104, psychoacoustic weighting signal generating circuit 105, psychoacoustic weighting signal reproducing circuit 106, adopt ive codebook searching circuit 109, multi-pulse searching circuit 110, and auxiliary multi-pulse searching circuit 112. Number Np in the former sentence represents the degree of linear predictive analysis and, for example may take a value of 10. The correlation method and the covariance method are two examples of linear predictive analysis and they are explained in detail in chapter five of "Digital Audio Processing" published by Tohkai University Press in Japan.

Linear predictor coefficient quantizing circuit 104 quantizes the linear predictor coefficients for each frame instead of sub-frame. In order to decrease bitrate, it is common to adopt the method in which only the last sub-frame in the present frame is quantized and the rest of the sub-frames in the frame are interpolated using the quantized linear predictor coefficients of the present frame and the preceding frame. The quantization and interpolation are executed after converting linear predictor coefficients to line spectrum pairs (LSP). The conversion from linear predictor coefficients to LSP is explained in "Speech data Compression by LSP Speech Analysis-Synthesis Technique" in Journal of the Institute of Electronics, Information and Communication Engineers, J64-A, pp. 599–606, 1981. Well-known methods can be used for quantizing LSP. One example of such methods is explained in Japanese Patent Laid-open 4-171500.

After converting quantized LSPs to quantized linear predictor coefficients a'(i) (i=1,2,3, . . . , Np), linear predictive coefficient quantizing circuit 104 supplies the quantized linear predictor coefficients to psychoacoustic weighting signal reproducing circuit 106, adaptive codebook searching circuit 109, multi-pulse searching circuit 110, and auxiliary multi-pulse searching circuit 112 and supplies indices representing quantized LSPs to multiplexer 114.

Psychoacoustic weighting signal generating circuit 105 drives the psychoacoustically weighting filter Hw(z) represented by equation (1) by input signal in a sub-frame to generate psychoacoustically weighted signal which is supplied to target signal generating circuit 108:

$$Hw(z) = \frac{1 - \sum_{i=1}^{N_p} a(i) R_2^i z^{-i}}{1 - \sum_{i=1}^{N_p} a(i) R_1^i z^{-i}}, \tag{1}$$

where $R_1$ and $R_2$ are weighting coefficients which control the amount of psychoacoustic weighting. For example, $R_1$=0.6 and $R_2$=0.9.

Psychoacoustic weighting signal reproducing circuit 106 drives a psychoacoustically weighting synthesis filter by excitation signal of the preceding sub-frame which is supplied via sub-frame buffer 107. The psychoacoustic weighting synthesis filter consists of a linear predictive synthesis filter represented by equation (2) and psychoacoustically weighting filter Hw(z) in cascade connection whose coefficients are of the preceding sub-frame and have been held therein:

$$H_s(z) = \frac{1}{1 - \sum_{i=1}^{N_p} a'(i) z^{-i}}. \tag{2}$$

After the driving, psychoacoustic weighting signal reproducing circuit 106 drives the psychoacoustically weighting synthesis filter by a series of zero signals to calculate the response to zero inputs. The response is supplied to target signal generating circuit 108.

Target signal generating circuit 108 subtracts the response to zero inputs from the psychoacoustic weighting signal to get target signals X(n) (n=0,1,2, . . . , N−1) . Number N in the former sentence represents the length of a sub-frame. Target signal generating circuit 108 supplies the target signals to adaptive codebook searching circuit 109, multi-pulse searching circuit 110, gain searching circuit 111, auxiliary multi-pulse searching circuit 112, and auxiliary gain searching circuit 113.

Using excitation signal of the preceding sub-frame supplied through sub-frame buffer 107, adaptive codebook searching circuit 109 renews an adaptive codebook which has held past excitation signals. Adaptive vector signal Ad(n) (n=0,1,2, . . . , N−1) corresponding to pitch d is a signal delayed by pitch d which has been stored in the adaptive codebook. Here, if pitch d is longer than the length of a sub-frame N, adaptive codebook searching circuit 109 detaches d samples just before the present sub-frame and repeatedly connects the detached samples until the number of the samples reaches the length of a sub-frame N. Adaptive codebook searching circuit 109 drives the psychoacoustic weighting synthesis filter which is initialized for each sub-frame (hereinafter referred to as a psychoacoustic weighting synthesis filter in zero-state) by the generated adaptive code vector Ad(n) (n=0,1,2, . . . , N−1) to generate reproduced signals SAd(n) (n=0,1,2, . . . , N−1) and selects pitche d' which minimizes error E(d), which is the difference between target signals X(n) and SAd(n), from a group of d within a predetermined searching range, for example d=17, . . . , 144. Hereinafter the selected pitch d' will be referred to as d for simplicity.

$$E(d) = \sum_{n=1}^{N} X(n)^2 - \frac{\left(\sum_{n=1}^{N} X(n)SAd(n)\right)^2}{\sum_{n=1}^{N} SAd(n)^2} \tag{3}$$

Adaptive codebook searching circuit 109 supplies the selected pitch d to multiplexer 114, the selected adaptive code vector Ad (n) to gain searching circuit 111, and the regenerated signals SAd(n) to gain searching circuit 111 and multi-pulse searching circuit 110.

Multi-pulse searching circuit 110 searches for P pieces of non-zero pulse which constitute a multi-pulse signal. Here, the position of each pulse is limited to the pulse position candidates which were determined in advance. The pulse position candidates for a different non-zero pulse are different from one another. The non-zero pulses are expressed only by polarity. Therefore, the coding the multi-pulse signal is equivalent to selecting index j which minimizes error E(j) in equation (4):

$$E(j) = \sum_{n=1}^{N} X'(n)^2 - \frac{\left(\sum_{n=1}^{N} X'(n)SC_j(n)\right)^2}{\sum_{n=1}^{N} SC_j(n)^2}, \tag{4}$$

where SCj (n) (n=0,1,2, . . . , N−1) is a reproduced signal obtained by driving the psychoacoustic weighting synthesis filter in zero-state by multi-pulse signals Cj (n=0, 1,2, . . . , N−1) which is constituted for index j (j=0,1,2, . . . , J−1) which represents one of J pieces of combination of the pulse position candidate and the polarity, and X' (n) (n=0,1, 2, . . . , N−1) is a signal obtained by orthogonalizing the target signal X(n) by the reproduced signal SAd(n) of the adaptive code vector signal and given by equation (5):

$$X'(n) = X(n) - \frac{\sum_{n=1}^{N} X(n)SAd(n)}{\sum_{n=1}^{N} SAd(n)^2} SAd(n). \tag{5}$$

This method is explained in detail in "Fast CELP coding 10 based on algebraic codes" in proceedings of ICASSP, pp. 1957–1960, 1987.

Index j representing the multi-pulse signal can be transmitted with $$\sum_{p=0}^{P-1} (1 + \log_2 M(p))$$

bits where M(p)(p=0,1,2, . . . , P−1) is the number of the pulse position candidates for the p-th pulse. For example, the number of bits necessary to transmit index j is 20 provided that sampling rate is 8 kHz, the length of a sub-frame is 5 msec (N =40 samples), the number of pulses P is five, the number of the pulse position candidates M(p)=8, p=0,1, 2, . . . , P-1, and the number of the pulse position candidates is, for simplicity, constant.

Multi-pulse searching circuit 110 supplies selected multi-pulse signal Cj (n) and the reproduced signal SCj (n) for the multi-pulse signal to gain searching circuit 111 and corresponding index j to multiplexer 114.

Gain searching circuit 111 searches for the optimum gain consisting of GA(k) and GE(K) (k=0,1,2, . . . , K−1) for a pair of the adaptive code vector signal and the multi pulse signal from again codebook of size K. Index k of the optimum gain is selected so as to minimize error E(k) in equation (6):

$$E(k) = \sum_{n=1}^{N} [X(n) - GA(k)SAd(n) - GE(k)SCj(n)]^2, \tag{6}$$

where X(n) is the target signal, SAd(n) is the reproduced adaptive code vector, and SCj (n) is the reproduced multi-pulse signal.

Gain searching circuit 111 also generates excitation signal D(n) (n=0,1,2, . . . , N−1) using the selected gain, the adaptive code vector, and the multi-pulse pulse signal. Excitation signal D(n) is supplies to sub-frame buffer 107 and auxiliary multi-pulse searching circuit 112. Moreover, gain searching circuit 111 drives the psychoacoustic weighting filter in zero-state by excitation signal D(n) to generate reproduced excitation signal SD(n) (n=0,1,2, . . . , N−1) which is supplied to auxiliary multi-pulse searching circuit 112, auxiliary gain searching circuit 113, and multiplexer 114.

Similarly to multi-pulse searching circuit 110, auxiliary multi-pulse searching circuit 112 generates auxiliary multi-pulse signal Cm(n) (n=0,1,2, . . . , N−1) and regenerated auxiliary multi-pulse signal SCm(n) (n=0,1,2, . . . , N−1) and selects m which minimizes error E(m) in equation (7):

$$E(m) = \sum_{n=1}^{N} X''(n)^2 - \frac{\left(\sum_{n=1}^{N} X''(n)SCm(n)\right)^2}{\sum_{n=1}^{N} SCm(n)^2}, \tag{7}$$

where X" (n) (n 32 0,1,2, . . . , N−1) is a signal obtained by orthogonalizing target signal X(n) by reproduced signal SD(n) of the excitation signal and given by equation (8):

$$X''(n) = X(n) - \frac{\sum_{n=1}^{N} X(n)SD(n)}{\sum_{n=1}^{N} SD(n)^2} SD(n). \tag{8}$$

Index m representing multi-pulse signal C(m) can be transmitted with $$\sum_{p=0}^{p'-1} (1 + \log_2 M'(p))$$

bits where P' is the number of auxiliary multi-pulse signals and M' (p) (p 32 0,1,2, . . . , P'−1) is the number of the pulse position candidates for p-th pulse. For example, the number of bits necessary to transmit index m is 20 provided that the number of pulses P' is five, the number of the pulse position candidates for each pulse M' (p) is 8, p=0,1,2, . . . , P'−1, and the number of the pulse position candidates is, for simplicity, constant.

Auxiliary multi-pulse searching circuit 112 also supplies regenerated signal SCm(n) to auxiliary gain searching circuit 113 and corresponding index m to multiplexer 114.

Auxiliary gain searching circuit 113 searches for the optimum gain consisting of GEA(l) and GEC(l) (l=0,1, 2, . . . , K'−1) for a pair of the excitation signal and the auxiliary multi-pulse signal from a gain codebook of size K'. Index l of the optimum gain is selected so as to minimize error E(l) in equation (9)

$$E(l) = \sum_{n=1}^{N} [X(n) - GEA(l)Sd(n) - GEC(l)SCm(n)]^2, \tag{9}$$

where X(n) is the target signal, SD(n) is the reproduced excitation signal, and SCm(n) is the reproduced auxiliary multi-pulse signal.

Selected index l is supplied to multiplexer 114.

Multiplexer 114 converts indices, which correspond to the quantized LSP, the adaptive code vector, the multi-pulse signal, the gains, the auxiliary multi-pulse signal and the auxiliary gains, into a bitstream which is supplied to first output terminal 115.

Bitstream from second input terminal 117 is supplied to demultiplexer 117. Demultiplexer 117 converts the bitstream into the indices which correspond to the quantized LSP, the adaptive code vector, the multi-pulse signal, the gains, the auxiliary multi-pulse signal and the auxiliary gains. Demultiplexer 117 also supplies the index of the quantized LSP to linear predictor coefficient decoding circuit 118, the index of the pitch to adaptive codebook decoding circuit 119, the index of the multi-pulse signal to multi-pulse decoding circuit 120, the index of the gains to gain decoding circuit 121, the index of the auxiliary multi-pulse signal to auxiliary multi-pulse decoding circuit 124, and the index of the auxiliary gains to auxiliary gain decoding circuit 125.

Linear predictor coefficient decoding circuit 118 docodes the index of the quantized LSP to quantized linear predictor coefficients a' (i) (i=1,2,3, . . . , Np) which is supplied to first signal reproducing circuit 122 and second signal reproducing circuit 126.

Adaptive codebook decoding circuit 119 decodes the index of the pitch to adaptive code vector Ad(n) which is supplied to gain decoding circuit 121. Multi-pulse decoding circuit 120 decodes the index of the multi-pulse signal to multi-pulse signal Cj(n) which is supplied to gain decoding circuit 121. Gain decoding circuit 121 decodes the index of the gains to gains GA(k) and GC(k) and generates a first excitation signal using gains GA(k) and GC(k), adaptive code vector Ad(n), multi-pulse signal Cj(n) and gains GA(k) and GC(k). The first excitation signal is supplied to first signal reproducing circuit 122 and auxiliary gain decoding circuit 125.

First signal reproducing circuit 122 generates a first reproduced signal by driving linear predictive synthesis filter Hs(z) with the first excitation signal. The first reproduced signal is supplied to second output terminal 123.

Auxiliary multi-pulse decoding circuit 124 decodes the index of the auxiliary multi-pulse signal to auxiliary multi-pulse signal Cm(n) which is supplied to auxiliary gain decoding circuit 125. Auxiliary gain decoding circuit 125 decodes the index of the auxiliary gains to auxiliary gains GEA(l) and GEC (l) and generates a second excitation signal using the first excitation signal, auxiliary multi-pulse signal Cm(n) and auxiliary gains GEA(l) and GEC(l).

Second signal reproducing circuit 126 generates a second reproduced signal by driving linear predictive synthesis filter Hs(z) with the second excitation signal. The second reproduced signal is supplied to third output terminal 127.

The conventional method explained above has a disadvantage that coding efficiency of a multi-pulse signal in the second stage and following stages is not sufficient because there is a possibility that each stage locates pulses in the same positions with those of pulses encoded in former stages. Because a multi-pulse signal is represented by positions and polarities of pulses, the same multi-pulse is formed when plural pulses are located in the same position and when one pulse is located therein. Therefore, coding efficiency is not improved when plural pulses are located in the same position.

SUMMARY OF THE INVENTION

An object of the present invention is to provide an audio encoding apparatus which efficiently encodes a multi-pulse in multiple stages and a corresponding audio decoding apparatus.

According to an aspect of the present invention, there is provided an audio encoding apparatus for encoding in multiple stages a multi-pulse signal representing excitation signal of a reproduced audio signal by plural pulses so that difference between the reproduced audio signal and an input audio signal is minimized, the reproduced audio signal being obtained by driving a linear predictive synthesis filter by means of the excitation signal, which comprises between the stages a multi-pulse setting circuit which sets pulse positions so that positions to which no pulse is located are selected prior to positions at which pulses have been already encoded in preceding stages, wherein each of the multi stages encodes pulses of the multi-pulse signal which are in the pulse positions set by the multi-pulse setting circuit.

According to another aspect of the present invention, there is provided an audio decoding apparatus for reproducing an audio signal by driving a linear predictive synthesis filter by means of an excitation signal, coefficients of the linear predictive synthesis filter being reproduced from data encoded in a encoding apparatus, the excitation signal being represented by plural pulses reproduced in multiple stages from data encoded in corresponding multiple stages in the encoding apparatus, which comprises between the stages a multi-pulse setting circuit which sets pulse positions so that position to which no pulse is located are selected prior to positions at which pulses have been already decoded in preceding stages, wherein each of the multi stages decodes pulses of the multi-pulse signal which is in the pulse positions set by the multi-pulse setting circuit.

According to the present invention, the multi-pulse setting circuit (an auxiliary multi-pulse setting circuit) sets candidates for pulse positions so that the pulse positions to which no pulse has been located are selected prior to the pulse positions at which pulses have been already encoded, and a multi-pulse searching circuit following the multi-pulse setting circuit selects pulse positions from the candidates and encodes the selected pulse positions. Thus, the multi-pulse searching circuit encodes the information concerning the selected pulse positions among candidates of pulse positions from which positions of already encoded pulses are excluded, whereby required number of bits for the encoding can be reduced.

These and other objects, features and advantages of the present invention will become more apparent in light of the following detailed description of the best mode embodiments thereof, as illustrated in the accompanying drawings.

DETAILED DESCRIPTION OF THE PREFERRED EMBODIMENT

A preferred embodiment according to the present invention will be explained with reference to the accompanying drawings.

Figure 1A:
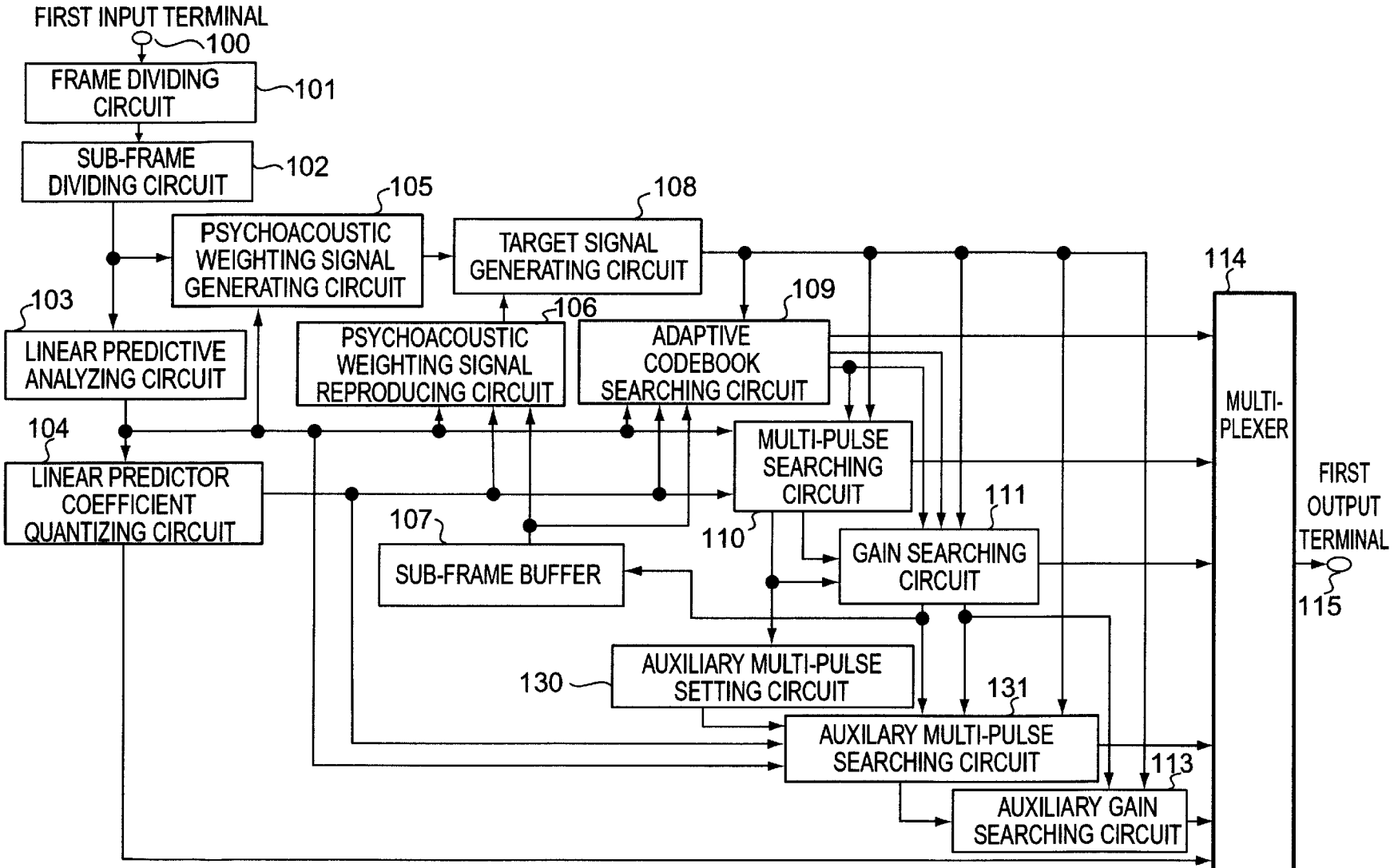
FIG. 1A shows an audio encoding apparatus according to one embodiment of the present invention.
Figure 1B:
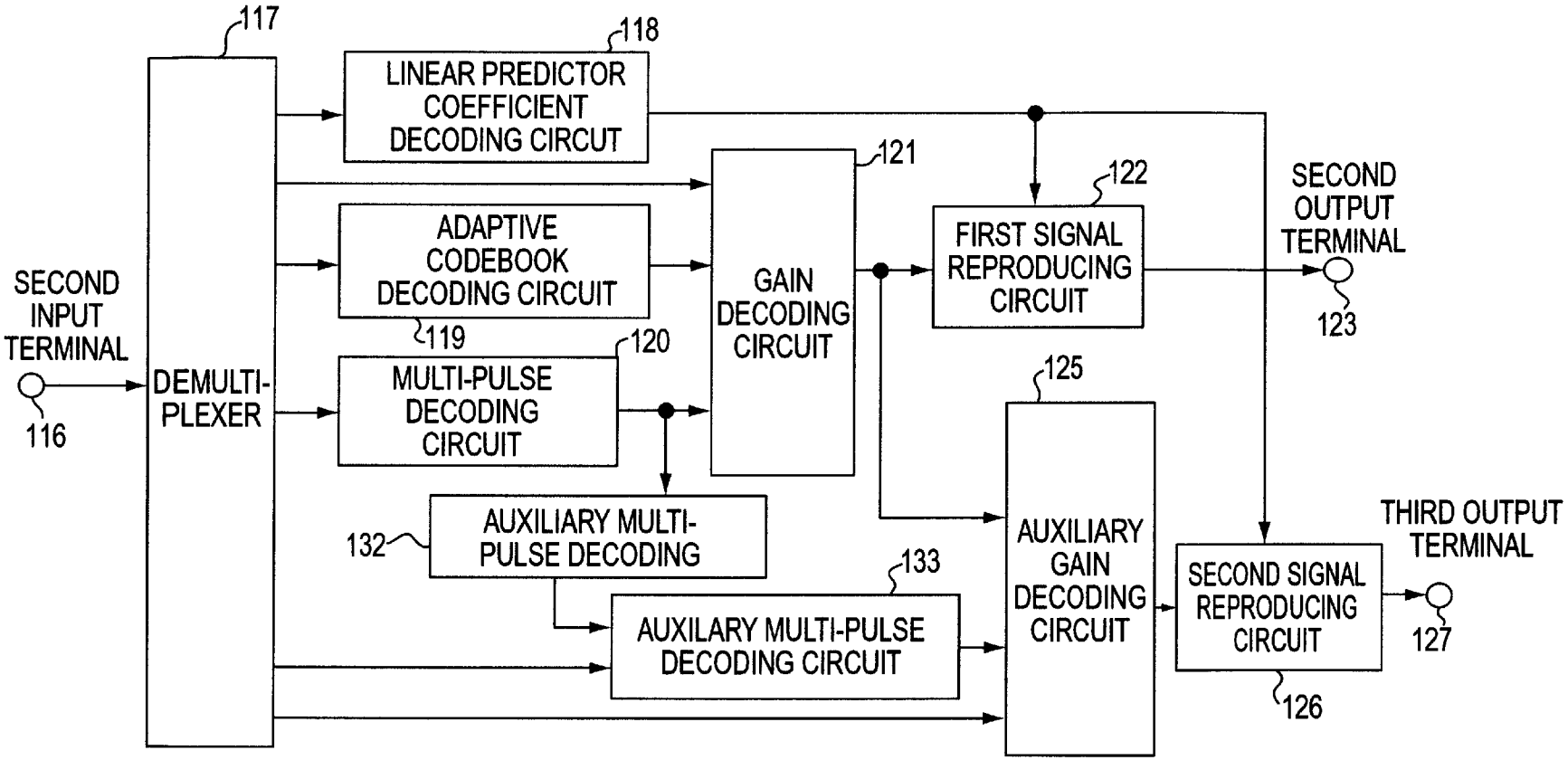
FIG. 1B shows an audio decoding apparatus according to one embodiment of the present invention.
Figure 2A:
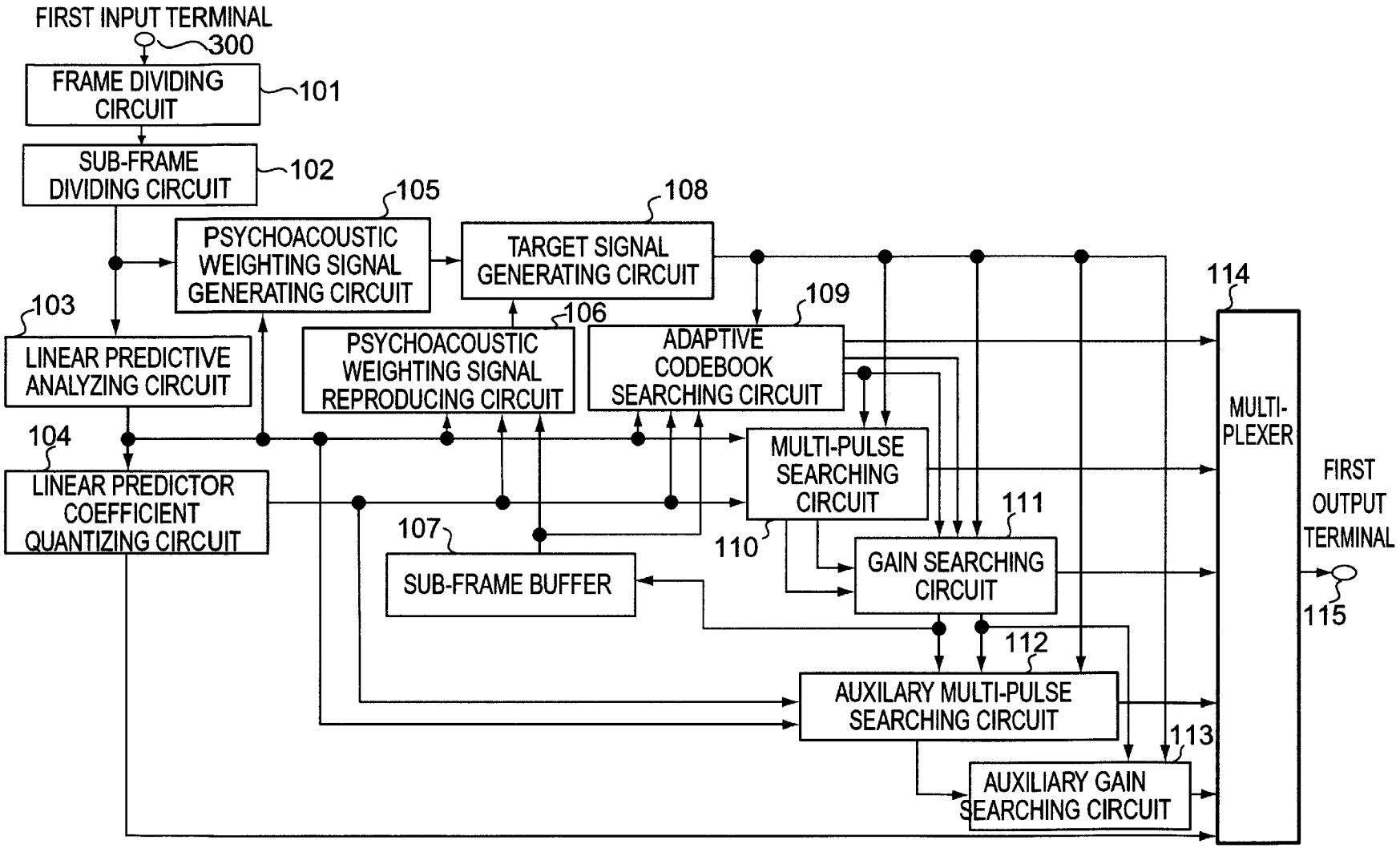
FIG. 2A shows an audio encoding apparatus in the prior art.
Figure 2B:
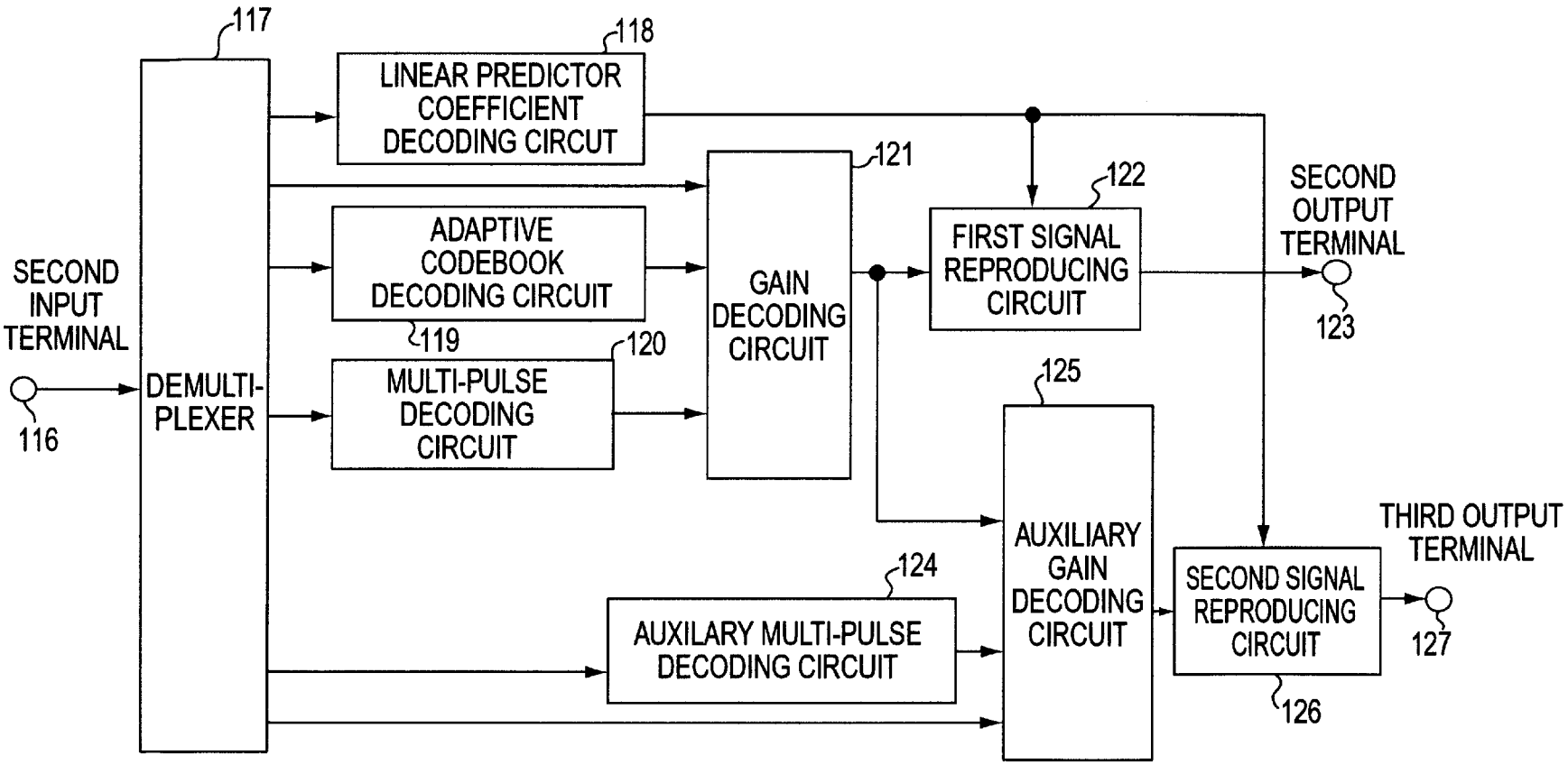
FIG. 2B shows an audio decoding apparatus in the prior art.

FIGS. 1A and 1B show an audio encoding apparatus and an audio decoding apparatus according to one embodiment of the present invention.

Although only two excitation signal encoding blocks are connected in the apparatuses for simplicity, the following explanation can be extended to the structure of three or more stages.

Differences between the apparatuses according to this embodiment and the prior art are the addition of multi-pulse setting circuits 130 and 132, replacement of auxiliary multi-pulse searching circuit 112 by auxiliary multi-pulse searching circuit 131, and replacement of auxiliary multi-pulse decoding circuit 124 by auxiliary multi-pulse decoding circuit 133. Therefore, only the differences will be explained, as follows.

Auxiliary multi-pulse setting circuit 130 sets candidates for pulse positions so that pulse positions to which no pulse has been assigned are selected in auxiliary multi-pulse searching circuit 131 prior to those of pulses already encoded in multi-pulse searching circuit 110. For example, auxiliary multi-pulse setting circuit 130 operates as follows: Auxiliary multi-pulse setting circuit 130 divides each sub-frame into $\underline{O}$ pieces of sub-areas. One pulse is assigned to each sub-area. Candidates for the position of each pulse is the sub-area. Auxiliary multi-pulse setting circuit 130 selects a limited number of sub-areas from the top of the ascending order of the number of pulses already encoded therein, and outputs the indices of the selected sub-areas. The indices may be called the indices of pulses because the pulses and the sub-areas are connected biuniquely. Auxiliary multi-pulse setting circuit 130 has candidates for pulse positions X(q, r) (q=0,1,2, . . . , Q-1; r=0,1,2, . . . , M"(q)−1) for $\underline{O}$ pieces of pulse in advance, where $\underline{O}$ represents the number of pulses, $\underline{q}$ represents pulse number, M"(q) represents the total number of candidates for pulse positions corresponding to pulse $\underline{q}$ , and $\underline{r}$ represents serial number of a candidate of a pulse position. Here, the number of pulses Q, for example, 10, is different from the number of pulses of the multi-pulse signal, for example, five which is the same as the prior art. In this embodiment, M"(q) is constant and four, which is quotient of division of the length of sub-frame 40 by the number of pulses 10, for all the values of $\underline{q}$ . A candidate for a pulse position X(q,r) for a certain pair of $\underline{q}$ and $\underline{r}$ is different from that for another pair of $\underline{q}$ and $\underline{r}$ . Auxiliary multi-pulse setting circuit 130 comprises counters Ctr(q) (q=0,1,2, . . . , Q−1) corresponding to $\underline{O}$ pieces of pulses. The initial values of counters Ctr(q) are zero. Pulse number $\underline{q}$ is extracted by searching for one candidate of which position is the same as that of a pulse of the multi-pulse signal supplied from multi-pulse searching circuit 110 from candidates for pulse positions X(q,r). The counter Ctr(q) corresponding to the extracted pulse number $\underline{q}$ is incremented. The same operation is repeated for all the pulses supplied from multi-pulse searching circuit 110. Subsequently, Q', for example, five, pieces of counters are selected from the top in ascending order of count values. Serial numbers of selected counters are represented by s(t) (t=0,1,2, . . . , Q'−1). Therefore, s(t) indicates one of pulse numbers ranging from zero to Q-1. In this meaning, s(t) may be called pulse number. In the selection, if plural counters take the same count value, for example the counter with minimum $\underline{q}$ is selected. Moreover, auxiliary multi-pulse setting circuit 130 supplies Q' pieces of selected pulse number s(t) (t=0,1,2, . . . , Q'−1) to auxiliary multi-pulse searching circuit 131.

Similarly to auxiliary multi-pulse setting circuit 130, auxiliary multi-pulse searching circuit 131 comprises candidates for pulse positions X(q,r) (q=0,1,2, . . . , Q-1; r=0,1, 2, . . . , M"(q)−1) for $\underline{O}$ pieces of pulse in advance. Auxiliary multi-pulse searching circuit 131searches for Q' pieces of non-zero pulse constituting an auxiliary multi-pulse signal.

Here, the position of the each pulse is limited within candidates for pulse position X(s(t),r) (r=0,1,2, . . . , M"(s (t))−1) in accordance with Q' pieces of pulse number s(t) (t=0,1,2, . . . , Q'−1). Moreover, the amplitudes of the pulses are represented only by polarity. Therefore, encoding of the auxiliary multi-pulse is performed by constituting auxiliary multi-pulse signals Cm(n) (n=0,1,2, . . . , N−1) for index m which represents one of all the combinations of candidates for pulse position and polarities, driving the psychoacoustic weighting synthesis filter in zero-state with auxiliary multi-pulse signals Cm(n) so as to generate reproduced signals SCm(n) (n=0,1,2, . . . , N−1), and selecting index m which minimizes error E(m) represented by equation (7). Selected index m can be encoded and transmitted with $$\sum_{t=0}^{Q'-1} (1 + \log_2 M''(s(t)))$$

bits. For example, substituting Q'=5 and M" (s(t))=4 for the equation, the number of bit is 15. That is, the number of bit required to encode an auxiliary multi-pulse signal is 15. The corresponding number in the prior art is 20. Therefore, the number of bit is reduced by five. Auxiliary multi-pulse searching circuit 131 supplies reproduced auxiliary multi-pulse signal SCm(n) to auxiliary gain searching circuit 113 and corresponding index $\underline{m}$ to multiplexer 114.

Auxiliary multi-pulse setting circuit 132 in the audio decoding apparatus operates in the same way as auxiliary multi-pulse setting circuit 130 in the audio encoding apparatus. That is, auxiliary multi-pulse setting circuit 132 selects pulse numbers s(t) (t=0,1,2, . . . , Q'−1) for Q' pieces of pulse in a multi-pulse supplied from multi-pulse decoding circuit 120, and supplies selected pulse numbers s(t) to auxiliary multi-pulse decoding circuit 133.

Auxiliary multi-pulse decoding circuit 133 reproduces the auxiliary multi-pulse signal using the index of the auxiliary multi-pulse signal supplied from demultiplexer 117 and pulse number s(t) (t=0,1,2, . . . , Q'−1) selected in auxiliary multi-pulse setting circuit 132 and referring to candidates for each pulse position X(s(t),r) (r=0,1,2, . . . , M"), and supplies the auxiliary multi-pulse signal to auxiliary gain decoding circuit 125.

As explained above, according to the audio encoding apparatus and the audio decoding apparatus of the present invention, the efficiency of encoding a multi-pulse signal in a second stage and following stages in multistage connection can be improved because plural pulses constituting the multi-pulse signal are scarcely located in the same position and the number of bits required for encoding can be reduced without deteriorating coding quality.

Although the present invention has been shown and explained with respect to the best mode embodiments thereof, it should be understood by those skilled in the art that the foregoing and various other changes, omissions, and additions in the form and detail thereof may be made therein without departing from the spirit and scope of the present invention.

What is claimed is:

1. An audio encoding apparatus for encoding in multiple stages a multi-pulse signal representing an excitation signal of a reproduced audio signal by plural pulses so that a difference between said reproduced audio signal and an input audio signal is minimized, said reproduced audio signal being obtained by driving a linear predictive synthesis filter with said excitation signal which corresponds to said multi-pulse signal, said audio encoding apparatus comprising:

a multi-pulse setting circuit, between said stages which sets pulse position candidates so that position candidates in which no pulse is located in a preceding stage or stages are selected prior to position candidates in which pulses have been already encoded in preceding stages; and a multi-pulse searching circuit, in each of said multiple stages, which encodes said multi-pulse signal by searching a pulse or pulses among said position candidates set by said multi-pulse setting circuit.

2. An audio encoding apparatus for encoding in multiple stages a multi-pulse signal representing an excitation signal of a reproduced audio signal by plural pulses so that a difference between said reproduced audio signal and an input audio signal is minimized, said reproduced audio signal being obtained by driving a linear predictive synthesis filter with said excitation signal, which comprises between said stages a multi-pulse setting circuit which sets pulse positions so that positions in which no pulse is located are selected prior to positions in which pulses have been already encoded in preceding stages, wherein each of said multiple stages encodes pulses of said multi-pulsc signal which are in the positions set by said multi-pulse setting circuit; and wherein said multi-pulse setting circuit divides each sub-frame into plural sub-areas, selects a limited number of said sub-areas from the top of the ascending order of the number of pulses already encoded therein, and outputs the indices of the selected sub-areas to a next stage.

3. The audio encoding apparatus as set forth in claim 2, wherein each of said multiple stages encodes pulses of said multi-pulse signal only in said sub-areas corresponding to said indices from said multi-pulse setting circuit.

4. An audio decoding apparatus for reproducing an audio signal by driving a linear predictive synthesis filter with an excitation signal, coefficients of said linear predictive synthesis filter being reproduced from data encoded apparatus in an encoding apparatus, said excitation signal being represented by a multi-pulse signal reproduced in multiple stages from data encoded in corresponding multiple stages in said encoding apparatus, said audio decoding apparatus comprising:

a multi-pulse setting circuit, between said stages, which sets pulse position candidates so that position candidates in which no pulse is located in a preceding stage or stages are selected prior to position candidates in which pulses have been already decoded in preceding stages; and a multi-pulse decoding circuit, in each of said multiple stages, which decodes said multi-pulse signal based on said pulse position candidates set by said multi-pulse setting circuit.

5. An audio decoding apparatus for reproducing an audio signal by driving a linear predictive synthesis filter with an excitation signal, coefficients of said linear predictive synthesis filter being reproduced from data encoded in an encoding apparatus, said excitation signal being represented by plural pulses reproduced in multiple stages from data encoded in corresponding multiple stages in said encoding apparatus, which comprises between said stages a multi-pulse setting circuit which sets pulse positions so that positions in which no pulse is located are selected prior to positions in which pulses have been already decoded in preceding stages, wherein each of said multiple stages decodes pulses of said multi-pulse signal which are in the pulse positions set by said multi-pulse setting circuit;

wherein said multi-pulse setting circuit divides each sub-frame into plural sub-areas, selects a limited number of said sub-areas from the top of the ascending order of the number of pulses already encoded therein, and outputs the indices of the selected sub-areas to a next stage.

6. The audio decoding apparatus as set forth in claim 5, wherein each of said multiple stages decodes pulses of said multi-pulse signal only in said sub-areas corresponding to said indices from said multi-pulse setting circuit.

7. An audio encoding apparatus for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said apparatus comprising:

main means for searching for a multi-pulse, wherein said main means encodes positions of pulses of said multi-pulse signal in a first stage by using said input audio signal on the basis of predetermined first pulse-position-candidate information; and at least one auxiliary means for searching for a multi-pulse;

wherein said auxiliary means for searching for a multi-pulse comprises:

an auxiliary multi-pulse setting circuit which sets second pulse-position-candidate information which will be used in a self-stage, on the basis of said multi-pulse signal which has been set in a preceding stage or stages; and an auxiliary multi-pulse searching circuit which encodes pulse positions of said multi-pulse signal in said self-stage by using said input audio signal on the basis of said second pulse-position-candidate information.

8. The audio encoding apparatus as set forth in claim 7, wherein said auxiliary multi-pulse setting circuit sets said second pulse-position-candidate information which gives priority to positions where no pulse has been located rather than positions which already have been encoded in said preceding stage or stages.

9. An audio decoding apparatus for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said apparatus comprising:

main means for creating a reproduced signal, wherein said main means creates a reproduced signal of a first stage from an excitation signal of said first stage and said linear predictor coefficients, said excitation signal of said first stage being reproduced from predetermined first pulse-position-candidate information; and at least one auxiliary means for creating a reproduced signal;

wherein said auxiliary means for creating a reproduced signal comprises:

an auxiliary multi-pulse setting circuit which sets second pulse-position-candidate information which will be used in a self-stage, on the basis of an excitation signal which has been decoded in a preceding stage or stages; and an auxiliary multi-pulse decoding circuit which decodes an excitation signal of said self-stage on the basis of said second pulse-position-candidate information; and wherein said auxiliary means for creating a reproduced signal creates an auxiliary reproduced signal by using said excitation signal of said self-stage and said linear predictor coefficients.

10. The audio decoding apparatus as set forth in claim 9, wherein said auxiliary multi-pulse setting circuit sets said second pulse-position-candidate information which gives priority to positions where no pulse has been located rather than positions which already have been set by decoding in said preceding stage or stages.

11. An audio encoding/decoding apparatus comprising:

an audio encoding apparatus for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said apparatus comprising:

main means for searching for a multi-pulse, wherein said main means encodes positions of pulses of said multi-pulse signal in a first stage by using said input audio signal on the basis of predetermined first pulse-position-candidate information; and at least one auxiliary means for searching for a multi-pulse;

wherein said auxiliary means for searching for a multi-pulse comprises:

an auxiliary multi-pulse setting circuit which sets second pulse-position-candidate information which will be used in a self-stage, on the basis of said multi-pulse signal which has been set in a preceding stage or stages; and an auxiliary multi-pulse encoding circuit which encodes pulse positions of said multi-pulse signal in said self-stage by using said input audio signal on the basis of said second pulse-position-candidate information; and an audio decoding apparatus for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said apparatus comprising:

main means for creating a reproduced signal, wherein said main means creates a reproduced signal of a first stage from an excitation signal of said first stage and said linear predictor coefficients, said excitation signal of said first stage being reproduced from predetermined first pulse-position-candidate information; and at least one auxiliary means for creating a reproduced signal;

wherein said auxiliary means for creating a reproduced signal comprises:

an auxiliary multi-pulse setting circuit which sets second pulse-position-candidate information which will be used in a self-stage, on the basis of an excitation signal which has been decoded in a preceding stage or stages; and an auxiliary multi-pulse decoding circuit which decodes an excitation signal of said self-stage on the basis of said second pulse-position-candidate information; and wherein said auxiliary means for creating a reproduced signal creates an auxiliary reproduced signal by using said excitation signal of said self-stage and said linear predictor coefficients.

12. The audio encoding/decoding apparatus as set forth in claim 11, wherein said auxiliary multi-pulse setting circuit sets said second pulse-position-candidate information which gives priority to positions where no pulse has been located rather than positions which already have been encoded in said preceding stage or stages.

13. The audio encoding/decoding apparatus as set forth in claim 11, wherein said auxiliary multi-pulse setting circuit sets said second pulse-position-candidate information which gives priority to positions where no pulse has been located rather than positions which already have been set by decoding in said preceding stage or stages.

14. The audio encoding/decoding apparatus as set forth in claim 13, wherein said auxiliary multi-pulse setting circuit sets said second pulse-position-candidate information which gives priority to positions where no pulse has been located rather than positions which already have been encoded in said preceding stage or stages.

15. An audio encoding method for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said method comprising:

a main step of searching for a multi-pulse, wherein said main step encodes positions of pulses of said multi-pulse signal in a first stage by using said input audio signal on the basis of predetermined first pulse-position-candidate information; and at least one auxiliary step of searching for a multi-pulse, wherein said auxiliary step comprises:

an auxiliary multi-pulse setting step which sets second pulse-position-candidate information which will be used in a self-stage, on the basis of said multi-pulse signal which has been set in a preceding stage or stages; and an auxiliary multi-pulse searching step which encodes pulse positions of said multi-pulse signal in said self-stage by using said input audio signal on the basis of said second pulse-position-candidate information.

16. The audio encoding method as set forth in claim 15, wherein said auxiliary multi-pulse setting step sets said second pulse-position-candidate information which gives priority to positions where no pulse has been located rather than positions which already have been encoded in said preceding stage or stages.

17. An audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a main step of creating a reproduced signal, wherein said main step creates a reproduced signal of a first stage from an excitation signal of said first stage and said linear predictor coefficients, said excitation signal of said first stage being reproduced from predetermined first pulse-position-candidate information; and at least one auxiliary step of creating a reproduced signal, wherein said auxiliary step comprises:

an auxiliary multi-pulse setting step which sets second pulse-position-candidate information which will be used in a self-stage, on the basis of an excitation signal which has been decoded in a preceding stage or stages; and an auxiliary multi-pulse decoding step which decodes an excitation signal of said self-stage on the basis of said second pulse-position-candidate information; and wherein said auxiliary step of creating a reproduced signal creates an auxiliary reproduced signal by using said excitation signal of said self-stage and said linear predictor coefficients.

18. The audio decoding method as set forth in claim 17, wherein said auxiliary multi-pulse setting step sets said second pulse-position-candidate information which gives priority to positions where no pulse has been located rather than positions which already have been set by decoding in said preceding stage or stages.

19. An audio encoding/decoding method comprising the steps of:

an audio encoding method for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said method comprising:

a main step of searching for a multi-pulse, wherein said main step encodes positions of pulses of said multi-pulse signal in a first stage by using said input audio signal on the basis of predetermined first pulse-position-candidate information; and at least one auxiliary step of searching for a multi-pulse, wherein said auxiliary step comprises:

an auxiliary multi-pulse setting step which sets second pulse-position-candidate information which will be used in a self-stage, on the basis of said multi-pulse signal which has been set in a preceding stage or stages; and an auxiliary multi-pulse encoding step which encodes pulse positions of said multi-pulse signal in said self-stage by using said input audio signal on the basis of said second pulse-position-candidate information; and an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a main step of creating a reproduced signal, wherein said main step creates a reproduced signal of a first stage from an excitation signal of said first stage and said linear predictor coefficients, said excitation signal of said first stage being reproduced from predetermined first pulse-position-candidate information; and at least one auxiliary step of creating a reproduced signal, wherein said auxiliary step comprises:

an auxiliary multi-pulse setting step which sets second pulse-position-candidate information which will be used in a self-stage, on the basis of an excitation signal which has been decoded in a preceding stage or stages; and an auxiliary multi-pulse decoding step which decodes an excitation signal of said self-stage on the basis of said second pulse-position-candidate information; and wherein said auxiliary step of creating a reproduced signal creates an auxiliary reproduced signal by using said excitation signal of said self-stage and said linear predictor coefficients.

20. The audio encoding/decoding method as set forth in claim 19, wherein said auxiliary multi-pulse setting step sets said second pulse-position-candidate information which gives priority to positions where no pulse has been located rather than positions which already have been encoded in said preceding stage or stages.

21. The audio encoding/decoding method as set forth in claim 19, wherein said auxiliary multi-pulse setting step sets said second pulse-position-candidate information which gives priority to positions where no pulse has been located rather than positions which already have been set by decoding in said preceding stage or stages.

22. The audio encoding/decoding method as set forth in claim 21, wherein said auxiliary multi-pulse setting step sets said second pulse-position-candidate information which gives priority to positions where no pulse has been located rather than positions which already have been encoded in said preceding stage or stages.

23. An audio encoding apparatus for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said apparatus comprising:

at least one auxiliary means for searching for a multi-pulse, wherein said auxiliary means encodes pulse positions of a multi-pulse signal of a self-stage from said input audio signal on the basis of pulse-position-candidate information which gives priority to pulse positions where no pulse has been located rather than pulse positions which already have been encoded in a preceding stage or stages.

24. The audio encoding apparatus as set forth in claim 23, wherein said auxiliary means for searching for a multi-pulse comprises:

an auxiliary multi-pulse setting circuit which sets said pulse-position-candidate information which gives priority to pulse positions where no pulse has been located rather than pulse positions which already have been encoded in said preceding stage or stages; and an auxiliary multi-pulse encoding circuit which encodes pulse positions of said multi-pulse signal in said self-stage from said input audio signal on the basis of said pulse-position-candidate information set in said auxiliary multi-pulse setting circuit.

25. An audio decoding apparatus for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said apparatus comprising:

at least one auxiliary means for creating a reproduced signal, wherein said auxiliary means decodes an excitation signal of a self-stage on the basis of pulse-position-candidate information which gives priority to pulse positions where no pulse has been located rather than pulse positions which already have been set by decoding in a preceding stage or stages, and creates an auxiliary reproduced signal by using said excitation signal of said self-stage and said linear predictor coefficients.

26. The audio decoding apparatus as set forth in claim 25, wherein said auxiliary means for searching for a multi-pulse comprises:

an auxiliary multi-pulse setting circuit which sets said pulse-position-candidate information which gives priority to pulse positions where no pulse has been located rather than pulse positions which already have been set by decoding in said preceding stage or stages; and an auxiliary multi-pulse decoding circuit which decodes an excitation signal in said self-stage on the basis of said pulse-position-candidate information set in said auxiliary multi-pulse setting circuit.

27. An audio encoding/decoding apparatus comprising:

an audio encoding apparatus for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said apparatus comprising:

at least one auxiliary means for searching for a multi-pulse, wherein said auxiliary means encodes pulse positions of a multi-pulse signal of a self-stage from said input audio signal on the basis of pulse-position-candidate information which gives priority to pulse positions where no pulse has been located rather than pulse positions which already have been encoded in a preceding stage or stages; and an audio decoding apparatus for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said apparatus comprising:

at least one auxiliary means for creating a reproduced signal, wherein said auxiliary means decodes an excitation signal of a self-stage on the basis of pulse-position-candidate information which gives priority to pulse positions where no pulse has been located rather than pulse positions which already have been set by decoding in a preceding stage or stages, and creates an auxiliary reproduced signal by using said excitation signal of said self-stage and said linear predictor coefficients.

28. The audio encoding/decoding apparatus as set forth in claim 27, wherein said auxiliary means for searching for a multi-pulse comprises:

an auxiliary multi-pulse setting circuit which sets said pulse-position-candidate information which gives priority to pulse positions where no pulse has been located rather than pulse positions which already have been encoded in said preceding stage or stages; and an auxiliary multi-pulse encoding circuit which encodes pulse positions of said multi-pulse signal in said self-stage from said input audio signal on the basis of said pulse-position-candidate information set in said auxiliary multi-pulse setting circuit.

29. The audio encoding/decoding apparatus as set forth in claim 27, wherein said auxiliary means for searching for a multi-pulse comprises:

an auxiliary multi-pulse setting circuit which sets said pulse-position-candidate information which gives priority to pulse positions where no pulse has been located rather than pulse positions which already have been set by decoding in said preceding stage or stages; and an auxiliary multi-pulse decoding circuit which decodes an excitation signal in said self-stage on the basis of said pulse-position-candidate information set in said auxiliary multi-pulse setting circuit.

30. The audio encoding/decoding apparatus as set forth in claim 29, wherein said auxiliary means for searching for a multi-pulse comprises:

an auxiliary multi-pulse setting circuit which sets said pulse-position-candidate information which gives priority to pulse positions where no pulse has been located rather than pulse positions which already have been encoded in said preceding stage or stages; and an auxiliary multi-pulse encoding circuit which encodes pulse positions of said multi-pulse signal in said self-stage from said input audio signal on the basis of said pulse-position-candidate information set in said auxiliary multi-pulse setting circuit.

31. An audio encoding method for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said method comprising:

a first step of setting pulse-position-candidate information which gives priority to pulse positions where no pulse has been located rather than pulse positions which already have been encoded in a preceding stage or stages; and a second step of encoding pulse positions of said multi-pulse signal in a self-stage by using said input audio signal on the basis of said pulse-position-candidate information set at said first step.

32. An audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a first step of decoding an excitation signal of a self-stage on the basis of pulse-position-candidate information which gives priority to pulse locations where no pulse has been located rather than pulse positions which have been set in decoding in a preceding stage or stages; and a second step of creating an auxiliary reproduced signal by using said excitation signal of said self-stage reproduced at said first step and said linear predictor coefficients.

33. The audio decoding method as set forth in claim 32, wherein said first step comprises:

an auxiliary multi-pulse setting step of setting said pulse-position-candidate information which gives priority to pulse positions where no pulse has been located rather than pulse positions which already have been set in decoding in said preceding stage or stages; and an auxiliary multi-pulse decoding step of decoding said excitation signal of said self-stage on the basis of said pulse-position-candidate information which has been set in said auxiliary multi-pulse setting step.

34. An audio encoding/decoding method comprising an audio encoding method for encoding in multiple stages an excitation signal of an audio signal by selecting pulse positions of a multi-pulse signal which minimize distortion between an input audio signal and a reproduced audio signal, said excitation signal being expressed by said multi-pulse signal consisting of a plurality of pulses, said reproduced audio signal being obtained by exciting a linear predictive synthesis filter by said excitation signal, said method comprising:

a first step of setting pulse-position-candidate information which gives priority to pulse positions where no pulse has been located rather than pulse positions which already have been encoded in a preceding stage or stages; and a second step of encoding pulse positions of said multi-pulse signal in a self-stage by using said input audio signal on the basis of said pulse-position-candidate information set at said first step; and an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a first step of decoding an excitation signal of a self-stage on the basis of pulse-position-candidate information which gives priority to pulse locations where no pulse has been located rather than pulse positions which have been set in decoding in a preceding stage or stages; and a second step of creating an auxiliary reproduced signal by using said excitation signal of said self-stage reproduced at said first step and said linear predictor coefficients.

35. The audio encoding/decoding method as set forth in claim 34, wherein said first step comprises:

an auxiliary multi-pulse setting step of setting said pulse-position-candidate information which gives priority to pulse positions where no pulse has been located rather than pulse positions which already have been set in decoding in said preceding stage or stages; and an auxiliary multi-pulse decoding step of decoding said excitation signal of said self-stage on the basis of said pulse-position-candidate information which has been set in said auxiliary multi-pulse setting step.

36. A recordable medium on which a computer program is recorded, said computer program comprising instructions for executing an audio encoding method for encoding in multiple stages an excitation signal of an audio signal, said excitation signal being expressed by a multi-pulse signal consisting of a plurality of pulses, by selecting pulse positions of said multi-pulse signal which minimize distortion between an input audio signal and a reproduced audio signal, said reproduced audio signal being obtained by exciting a linear predictive synthesis filter by said excitation signal, said method comprising:

a first step of setting pulse-position-candidate information which gives priority to pulse positions where no pulse has been located rather than pulse positions which already have been encoded in a preceding stage or stages; and a second step of encoding pulse positions of said multi-pulse signal in a self-stage by using said input audio signal on the basis of said pulse-position-candidate information set at said first step.

37. A recordable medium on which a computer program is recorded, said computer program comprising instructions for executing an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a first step of decoding an excitation signal of a self-stage on the basis of pulse-position-candidate information which gives priority to pulse locations where no pulse has been located rather than pulse positions which have been set in decoding in a preceding stage or stages; and a second step of creating an auxiliary reproduced signal by using said excitation signal of said self-stage reproduced at said first step and said linear predictor coefficients.

38. The recordable medium as set forth in claim 37, wherein said first step comprises:

an auxiliary multi-pulse setting step of setting said pulse-position-candidate information which gives priority to pulse positions where no pulse has been located rather than pulse positions which already have been set in decoding in said preceding stage or stages; and an auxiliary multi-pulse decoding step of decoding said excitation signal of said self-stage on he basis of said pulse-position-candidate information which has been set in said auxiliary multi-pulse setting step.

39. A recordable medium on which a computer program is recorded, said computer program comprising instructions for executing an audio encoding method for encoding in multiple stages an excitation signal of an audio signal, said excitation signal being expressed by a multi-pulse signal consisting of a plurality of pulses, by selecting pulse positions of said multi-pulse signal which minimize distortion between an input audio signal and a reproduced audio signal, said reproduced audio signal being obtained by exciting a linear predictive synthesis filter by said excitation signal, said method comprising:

a first step of setting pulse-position-candidate information which gives priority to pulse positions where no pulse has been located rather than pulse positions which already have been encoded in a preceding stage or stages; and a second step of encoding pulse positions of said multi-pulse signal in a self-stage by using said input audio signal on the basis of said pulse-position-candidate information set at said first step; and said computer program comprising instructions for executing an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a first step of decoding an excitation signal of a self-stage on the basis of pulse-position-candidate information which gives priority to pulse locations where no pulse has been located rather than pulse positions which have been set in decoding in a preceding stage or stages; and a second step of creating an auxiliary reproduced signal by using said excitation signal of said self-stage reproduced at said first step and said linear predictor coefficients.

40. The recordable medium as set forth in claim 39, wherein said first step comprises:

an auxiliary multi-pulse setting step of setting said pulse-position-candidate information which gives priority to pulse positions where no pulse has been located rather than pulse positions which already have been set in decoding in said preceding stage or stages; and an auxiliary multi-pulse decoding step of decoding said excitation signal of said self-stage on he basis of said pulse-position-candidate information which has been set in said auxiliary multi-pulse setting step.

41. A recordable medium on which a computer program is recorded, said computer program comprising instructions for executing an audio encoding method for encoding in multiple stages an excitation signal of an audio signal, said excitation signal being expressed by a multi-pulse signal consisting of a plurality of pulse, by selecting pulse positions of said multi-pulse signal which minimize distortion between an input audio signal and a reproduced audio signal, said reproduced audio signal being obtained by exciting a linear predictive synthesis filter by said excitation signal, said method comprising:

a main step of searching for a multi-pulse, wherein said main step encodes positions of pulses of said multi-pulse signal in a first stage by using said input audio signal on the basis of first pulse-position-candidate information which already has been determined; and at least one auxiliary step of searching for a multi-pulse, wherein said auxiliary step comprises:

an auxiliary multi-pulse setting step which sets second pulse-position-candidate information, which will be used in a self-stage, on the basis of said multi-pulse signal which has been set in a preceding stage or stages; and an auxiliary multi-pulse encoding step which encodes pulse positions of said multi-pulse signal in said self-stage by using said input audio signal on the basis of said second pulse-position-candidate information.

42. The recordable medium as set forth in claim 41, wherein said auxiliary multi-pulse setting step sets said second pulse-position-candidate information which gives priority to positions where no pulse has been located rather than positions which already have been encoded in said preceding stage or stages.

43. A recordable medium on which a computer program is recorded, said computer program comprising instructions for executing an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a main step of creating a reproduced signal, wherein said main step creates a reproduced signal of a first stage from an excitation signal of said first stage and said linear predictor coefficients, said excitation signal of said first stage being reproduced from predetermined first pulse-position-candidate information; and at least one auxiliary step of creating a reproduced signal, wherein said auxiliary step comprises:

an auxiliary multi-pulse setting step which sets second pulse-position-candidate information, which will be used in a self-stage, on the basis of an excitation signal which has been decoded in a preceding stage or stages; and an auxiliary multi-pulse decoding step which decodes an excitation signal of said self-stage on the basis of said second pulse-position-candidate information; and wherein said auxiliary step of creating a reproduced signal creates an auxiliary reproduced signal by using said excitation signal of said self-stage and said linear predictor coefficients.

44. The recordable medium as set forth in claim 43, wherein said auxiliary multi-pulse setting step sets said second pulse-position-candidate information which gives priority to positions where no pulse has been located rather than positions which already have been set by decoding in said preceding stage or stages.

45. A recordable medium on which a computer program is recorded, said computer program comprising instructions for executing an audio encoding method for encoding in multiple stages an excitation signal of an audio signal, said excitation signal being expressed by a multi-pulse signal consisting of a plurality of pulse, by selecting pulse positions of said multi-pulse signal which minimize distortion between an input audio signal and a reproduced audio signal, said reproduced audio signal being obtained by exciting a linear predictive synthesis filter by said excitation signal, said method comprising:

a main step of searching for a multi-pulse, wherein said main step encodes positions of pulses of said multi-pulse signal in a first stage by using said input audio signal on the basis of first pulse-position-candidate information which already has been determined; and at least one auxiliary step of searching for a multi-pulse, wherein said auxiliary step comprises:

an auxiliary multi-pulse setting step which sets second pulse-position-candidate information, which will be used in a self-stage, on the basis of said multi-pulse signal which has been set in a preceding stage or stages; and an auxiliary multi-pulse encoding step which encodes pulse positions of said multi-pulse signal in said self-stage by using said input audio signal on the basis of said second pulse-position-candidate information; and said computer program comprising instructions for executing an audio decoding method for decoding, from encoded data, an excitation signal which has been encoded into an expression by a multi-pulse signal consisting of a plurality of pulses in multiple stages; decoding linear predictor coefficients from said encoded data; exciting a linear predictive synthesis filter having said linear predictor coefficients by said excitation signal, and thereby reproducing a reproduction of an audio signal, said method comprising:

a main step of creating a reproduced signal, wherein said main step creates a reproduced signal of a first stage from an excitation signal of said first stage and said linear predictor coefficients, said excitation signal of said first stage being reproduced from predetermined first pulse-position-candidate information; and at least one auxiliary step of creating a reproduced signal, wherein said auxiliary step comprises:

an auxiliary multi-pulse setting step which sets second pulse-position-candidate information, which will be used in a self-stage, on the basis of an excitation signal which has been decoded in a preceding stage or stages; and an auxiliary multi-pulse decoding step which decodes an excitation signal of said self-stage on the basis of said second pulse-position-candidate information; and wherein said auxiliary step of creating a reproduced signal creates an auxiliary reproduced signal by using said excitation signal of said self-stage and said linear predictor coefficients.

46. The recordable medium as set forth in claim 45, wherein said auxiliary multi-pulse setting step sets said second pulse-position-candidate information which gives priority to positions where no pulse has been located rather than positions which already have been encoded in said preceding stage or stages.

47. The recordable medium as set forth in claim 45, wherein said auxiliary multi-pulse setting step sets said second pulse-position-candidate information which gives priority to positions where no pulse has been located rather than positions which already have been set by decoding in said preceding stage or stages.

48. The recordable medium as set forth in claim 47, wherein said auxiliary multi-pulse setting step sets said second pulse-position-candidate information which gives priority to positions where no pulse has been located rather than positions which already have been encoded in said preceding stage or stages.

49. A bitstream indicative of results of setting positions of a multi-pulse in each stage on the basis of a audio signal and an excitation signal which has been set in a stage or stages preceding said each stage and encoding said positions, said bitstream comprising:

a first bitstream indicative of positions of a multi-pulse in a first stage, said first bitstream being generated by obtaining and encoding said positions of said multi-pulse in said first stage by using said audio signal; and a second bitstream indicative of positions of an auxiliary multi-pulse which are set by setting pulses at positions to which no pulse has been located in first through (n−1)-th stages when encoding an excitation signal at an n-th stage on the basis of an excitation signal encoded in first through (n−1)-th stages and said audio signal, wherein n is an integer greater than one.

50. The bitstream as set forth in claim 49, wherein said second bitstream is generated by encoding pulse positions which are set in a self-stage on the basis of pulse positions which are set by encoding in said preceding stage or stages.

* * * * *